US005145414A

United States Patent [19]

Oikawa

[11] Patent Number: 5,145,414

[45] Date of Patent: Sep. 8, 1992

[54] FUSE HOLDER CONSTRUCTION

[75] Inventor: Ryuetsu Oikawa, Shizuoka, Japan

[73] Assignee: Yazaki Corporation, Tokyo, Japan

[21] Appl. No.: 625,199

[22] Filed: Dec. 10, 1990

[30] Foreign Application Priority Data

Dec. 11, 1989 [JP] Japan ..... 1-142065[U]
Aug. 31, 1990 [JP] Japan ..... 2-90695[U]

[51] Int. Cl.[5] ..... H01R 13/68
[52] U.S. Cl. ..... 439/621; 439/374
[58] Field of Search ..... 439/374, 621, 622, 350, 439/351, 353; 337/186

[56] References Cited

U.S. PATENT DOCUMENTS 4,603,930 8/1986 Ito ..... 439/76
4,938,715 7/1990 Jones et al. ..... 439/718
4,993,565 2/1991 Eck ..... 439/374
5,030,130 7/1991 Natsume ..... 439/374

FOREIGN PATENT DOCUMENTS 2707442 11/1977 Fed. Rep. of Germany ..... 439/621

*Primary Examiner*—Gary F. Paumen
*Attorney, Agent, or Firm*—Sughrue, Mion, Zinn Macpeak & Seas

[57] ABSTRACT

A fuse holder construction enables retention of fuses within a fuse box when the fuses are disconnected. In one embodiment, retainer portions are formed on guide walls surrounding a fuse insertion position, for holding the fuse in place when it is inserted, and for holding it out of the way when the fuse is disconnected. In another embodiment, flexible retainer portions are formed on a fuse box cover an opening is provided opposite the fuse insertion position, and the flexible retainer portions are provided beneath the opening.

8 Claims, 4 Drawing Sheets

FUSE HOLDER CONSTRUCTION

BACKGROUND OF THE INVENTION

This invention relates to a construction for holding a disconnected fuse, used in an automobile or the like, when the fuse is not in use, in order to avoid dark current.

FIG. 8 shows a automobile fuse box disclosed in Japanese Laid-Open (Kokai) Utility Model Application No. 18947/87. The fuse box 15 is constituted by a fuse box body 16, and a fuse cover 17 attached to the fuse box body 16. Mounted within the fuse box body 16 are a plurality of insertion portions 18' for receiving respective plug-in type flanged-head fuses 8', as shown in FIG. 9. A specific one 18 among these insertion portions 18' is projected to a greater extent than the others so as to be more conspicuous. During a period from the manufacture of an automobile to the time when the automobile is delivered to the user, and also during a period when the automobile is not being operated, the specific fuse 8 is disconnected or withdrawn so as to prevent a battery from being consumed by dark current developing with respect to electrical parts, such as a clock, connected directly to the battery.

FIG. 10 shows one example of a wiring diagram for the above fuse box, including switches SW1 and SW2, an ordinary fuse 8', the specific fuse 8, reference battery E via the switches SW1 and SW2, and electrical parts Y and Z connected directly to the battery E, but not via the switches SW1 and SW2. However, in the above conventional construction, it is very cumbersome to store the withdrawn specific fuse 8, and there is a risk that the specific fuse may be lost.

SUMMARY OF THE INVENTION

With the above problems in view, it is an object of this invention to provide a fuse holder construction which enables easy storage of a fuse disconnected to avoid dark current, and also eliminates the possibility of losing the fuse.

In order to achieve the above and other objects, according to a first aspect of the invention, basically, there is provided a fuse holder construction characterized in that upstanding fuse guide walls each having a flexible portion are provided around a fuse connecting portion. A retainer projection for a fuse is formed on each of the flexible portions intermediate opposite ends of the flexible portion, and the fuse is retained by the retainer projections.

A flexible retainer pawl for the fuse can be formed on a distal end of each of the fuse guide walls, the fuse being adapted to be held between the retainer projections and the flexible retainer pawls. Also, when the fuse is inserted in the fuse connecting portion, the retainer projections can retain the fuse.

According to a second aspect of the invention, there is provided a fuse holder construction characterized in that an opening is formed in a cover of a fuse box, the opening being disposed in opposed relation to a fuse connecting portion. Flexible holder legs, each having an engaging projection for engagement with a fuse, depend from an outer peripheral portion of the opening. According to the first aspect of the invention, the fuse is inserted along the fuse guide walls, so that the fuse is abutted against the retainer projections to flex the flexible portions outwardly. Thus, the fuse is inserted into the fuse connecting portion. In this condition, the retainer projections prevent the withdrawal of the fuse. When the fuse is to be withdrawn from the fuse connecting portion, the flexible portions are similarly flexed outwardly, and the fuse is held by the retainer projections or between the retainer projections and the flexible retainer pawls.

According to the second aspect of the invention, the fuse is retained by the holder legs provided on the cover. In this condition, the fuse is pressed or urged through the opening to be inserted into the fuse connecting portion.

DETAILED DESCRIPTION OF THE PREFERRED EMBODIMENTS

Figure 1:
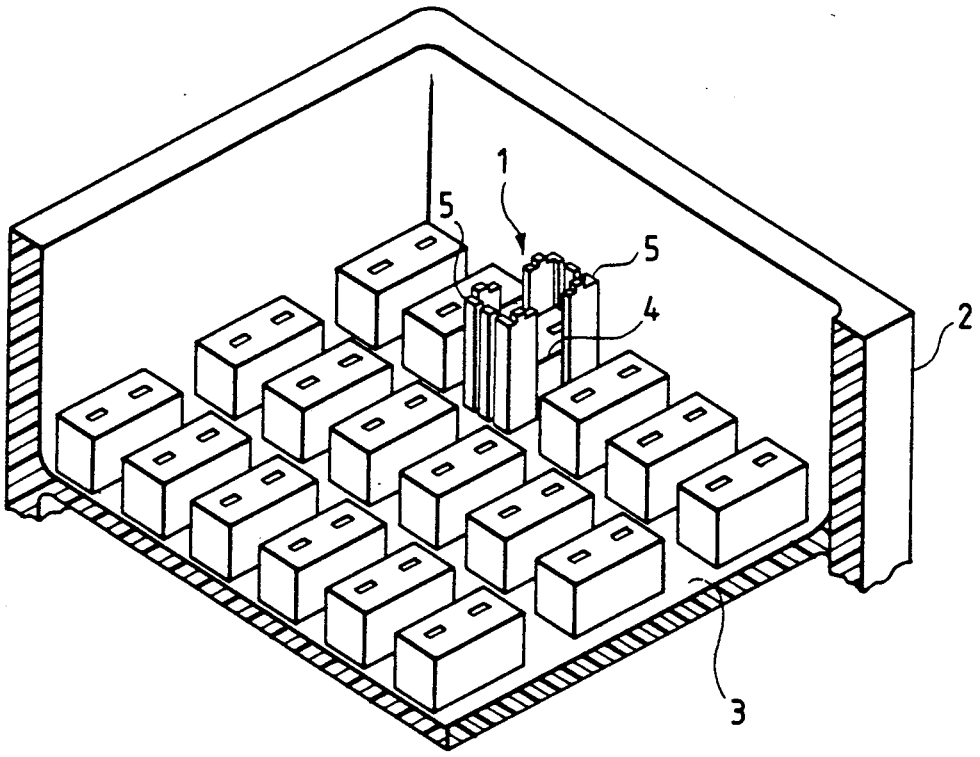
FIG. 1 is a perspective view of a portion of a fuse box to which a holder according to the present invention is applied.
Figure 2:
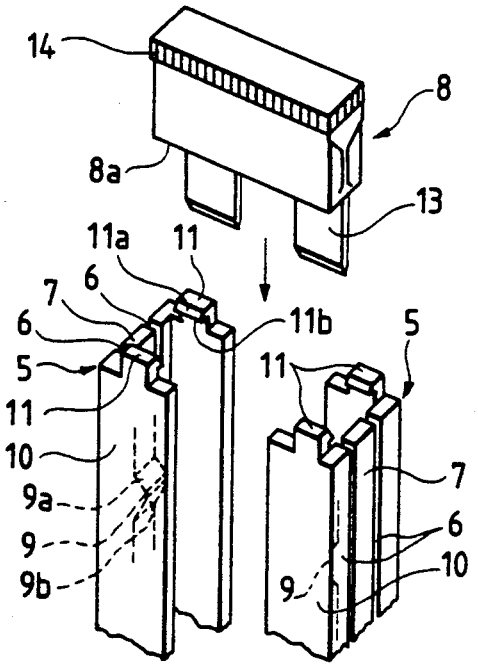
FIG. 2 is a perspective view of an important portion of the inventive holder.

In FIGS. 1 and 2, the holder construction 1 includes opposed fuse guide walls 5, 5 having a generally channel-shaped cross-section extending upwardly from a bottom wall 3 of the fuse box 2, the guide walls 5, 5 being provided adjacent to an outer periphery of a specific fuse insertion portion 4. A pair of parallel slits 6, 6 are formed longitudinally through a central portion of each fuse guide wall 5 to form a flexible portion 7 between opposed side wall portions 10 of each guide walls. A retainer projection 9 for retaining a flanged-head fuse 8 of the plug-in type is formed on the inner surface of each flexible portion 7 intermediate the opposite ends thereof. Inwardly-directed flexible retainer pawls 11, 11 are formed respectively on distal ends of opposed side wall portions 10 of each fuse guide wall 5.

Figure 3A:
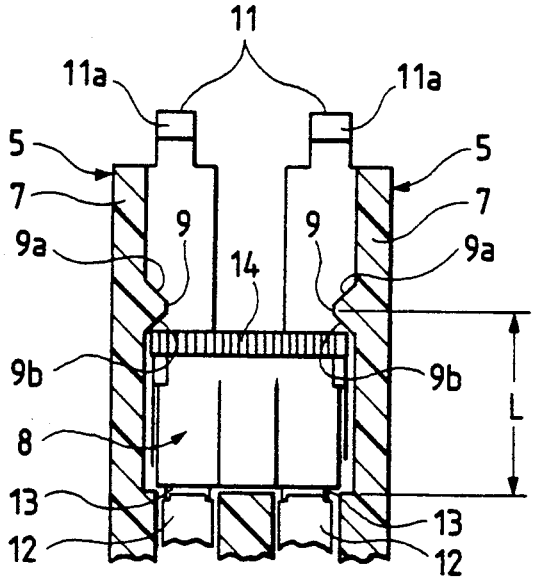
FIGS. 3A and 3B are cross-sectional views of the holder respectively through longitudinal and transverse planes, showing an inserted condition of a fuse.
Figure 3B:
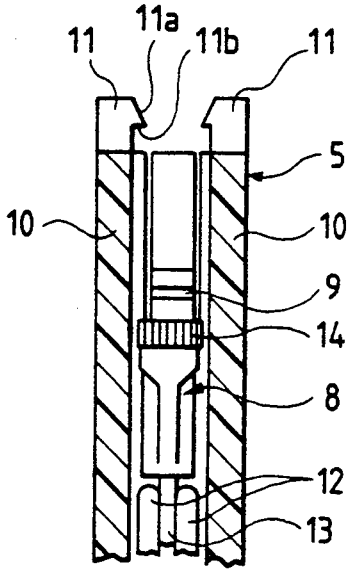
Figure 4A:
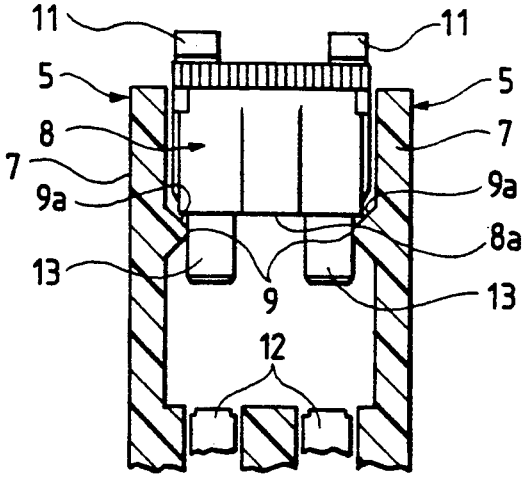
FIGS. 4A and 4B are cross-sectional views of the holder respectively through the longitudinal and transverse planes, showing a retained condition of the fuse.
Figure 4B:
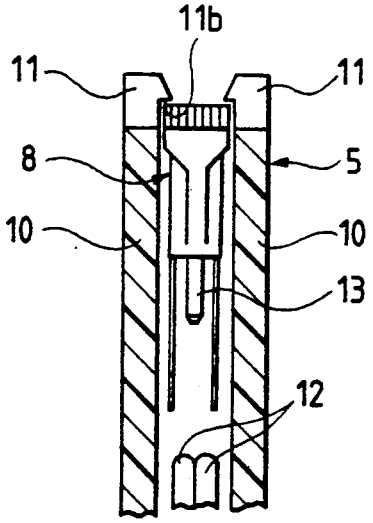

As shown in FIGS. 3A and 3B, each of the retainer projections 9 has an upwardly-directed inclined surface **9*a* and a downwardly-directed inclined surface 9*b*. A longitudinal dimension L is so determined that a flanged head 14 of the fuse 8 can be abutted against and retained by the downwardly-directed inclined surfaces 9*b*. A longitudinal dimension L is so determined that a flanged head 14 of the fuse 8 can be abutted against and retained by the downwardly-directed inclined surfaces 9*b* when tab terminals 13 of the fuse 8 are connected to the fuse insertion portion 4 having female terminals 12. Each retainer pawl 11 has an upwardly-directed inclined surface 11***a* and a downwardly-directed horizontal surface 11*b*. As shown in FIGS. 4A and 4B, the fuse 8 withdrawn from the fuse insertion portion 4 is held between the downwardly-directed horizontal surfaces 11*b* of the retainer pawls 11 and the upwardly-directed inclined surfaces 9*a* of the retainer projections 9.

When the fuse 8 is to be moved from the position shown in FIG. 2 to be inserted into the guide walls 5, a lower surface 8*a* of the fuse 8 urges the upwardly-directed inclined surfaces 11*a* of the retainer pawls 11 to flex the retainer pawls 11 outwardly, and similarly further urges the upwardly-directed inclined surfaces 9*a* of the retainer projections 9 to flex the flexible portions 7 outwardly. Then, simultaneously when the fuse 8 is inserted into the fuse insertion portion 4, the flanged head 14 is abutted against and retained by the downwardly-directed inclined surfaces 9*b* of the retainer projections 9, as shown in FIGS. 3A and 3B.

When the fuse 8 is to be withdrawn from the fuse insertion portion 4, the flanged head 14 urges the retainer projections 9 to flex the flexible portions 7 outwardly to enable withdrawal of the fuse. Then, simultaneously when the flanged head 14 is abutted against the downwardly-directed horizontal surfaces 11*b* of the retainer pawls 11, the lower surface 8*a* is retained by the upwardly-directed inclined surfaces 9*a* of the retainer projections 9, so that the fuse 8 is held between the retainer pawls 11 and the retainer projections 9.

As an alternative to the foregoing embodiment, there can be provided a construction of the type in which the fuse 8 is inserted in press-fitting relation to the retainer projections 9 of the flexible portions 7, thereby holding the fuse therebetween. As yet another alternative, retainer portions (not shown) such as retainer projections may be formed on the body of the fuse 8, and engaging portions (not shown) such as engaging holes engageable respectively with such retainer portions are formed respectively on the flexible portions 7 of the fuse guide walls 5. Still further, the fuse guide walls 5 themselves may be flexible, and the retainer projections 9 or the retainer pawls 11 may be formed on the fuse guide walls 5.

Figure 5:
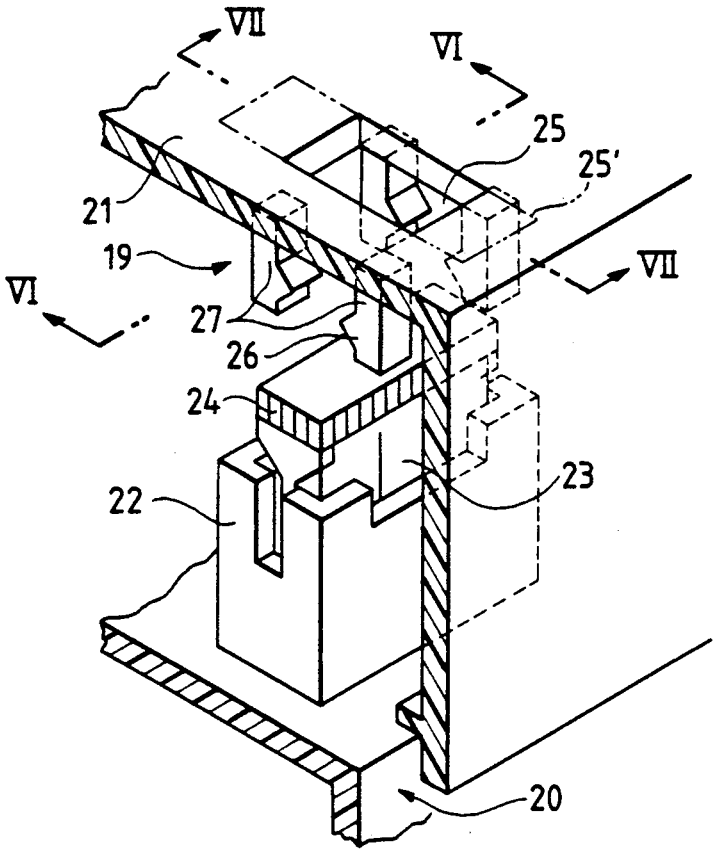
FIG. 5 is a perspective view of another embodiment of the invention.

FIG. 5 is a perspective view of another embodiment of a fuse holder construction according to the present invention. In this fuse holder construction 19, an opening 25 is formed through a cover 21 for a fuse box 20. The opening 25 is disposed in opposed relation to a head 24 of a fuse 23 inserted into a fuse insertion portion 22. Two pairs of opposed flexible holder legs 27 depend from the peripheral edge portion (i.e., the reverse surface of the cover 21) of the opening 25, each of the holder legs 27 having an engaging projection 26 for engagement with the fuse head 24. The opening 25 may be elongated as indicated by a dots-and-dash line 25'.

Figure 6:
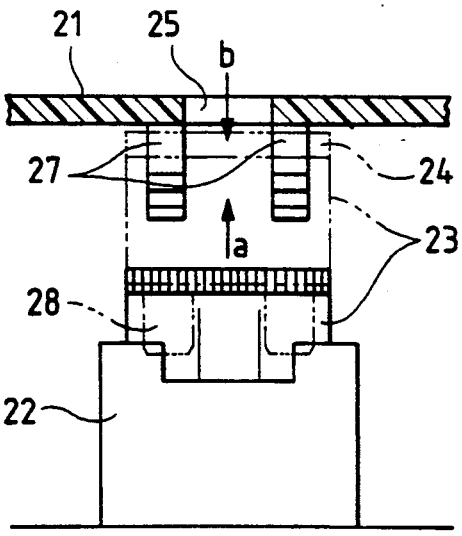
FIG. 6 is a cross-sectional view taken along the line VI—VI of FIG. 5, showing the operation of the embodiment.
Figure 7:
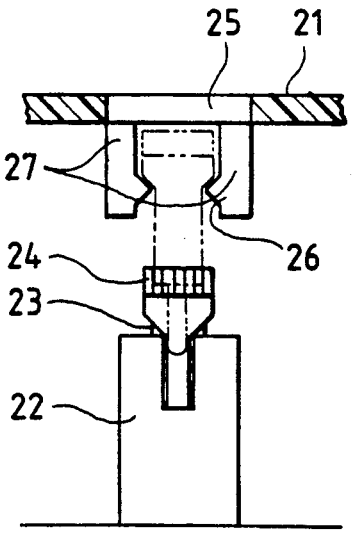
FIG. 7 is a cross-sectional view taken along the line VII—VII of FIG. 5.
Figure 8:
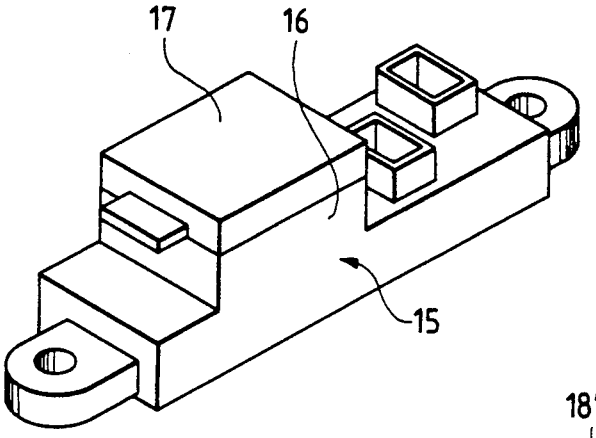
FIG. 8 PRIOR ART
FIG. 8 is a perspective view showing the appearance of a fuse box for a vehicle.
Figure 9:
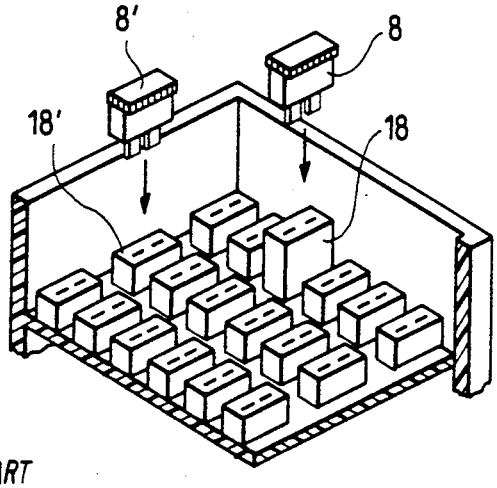
FIG. 9 PRIOR ART
FIG. 9 is a perspective view of a conventional fuse box.
Figure 10:
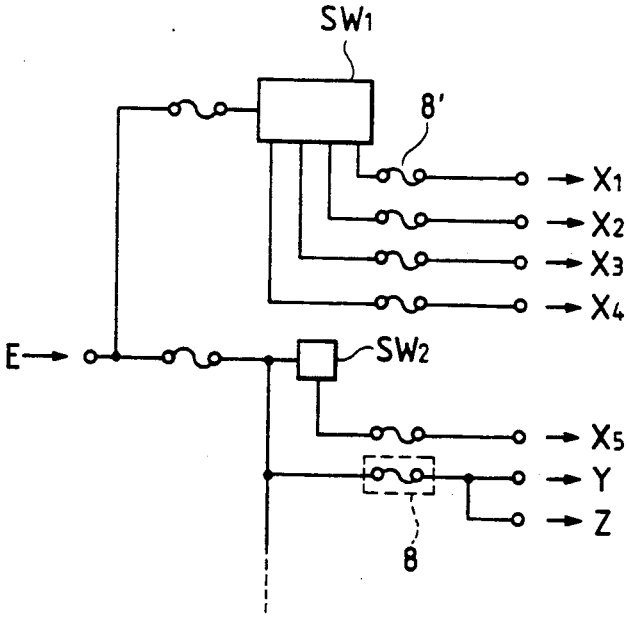
FIG. 10 PRIOR ART
FIG. 10 is a wiring diagram for the fuse box for a vehicle.

The fuse 23 is withdrawn in a direction of arrow a, as shown in FIGS. 6 and 7, by a jig or fingers inserted through the opening 25 (25') (or by removing the cover 21), so that the fuse head 24 is held between the holder legs 27. Preferably, the length of the holder legs 27 is so determined that in this condition, distal ends of tab terminals 28 of the fuse 23 remain received in the fuse insertion portion 22. When the fuse 23 is to be connected, the fuse head 24 is pressed or urged in a direction of arrow b by the fingers or other means through the opening 25, so that the fuse 23 can easily be inserted into the fuse insertion portion 22.

As described above, according to the present invention, the fuse is not removed, but rather can be retained, so that reconnection of the fuse whenever desired is easy, and losing the fuse is prevented. Further, previously necessary cumbersome storage no longer is needed. Also, the device is advantageous from the viewpoints of operability and maintenance. Further, the fuse inserted into the connecting portion is prevented from withdrawal, and therefore the fuse is prevented from accidental disengagement due to vibrations of a vehicle or the like.

While the invention has been described in detail above with reference to a preferred embodiment, various modifications within the scope and spirit of the invention will be apparent to people of working skill in this technological field. Thus, the invention should be considered as limited only by the scope of the appended claims.

What is claimed is:

1. A fuse holder for holding a fuse, said fuse holder comprising:

a fuse connecting portion having electrical contacts;

upstanding fuse guide walls each having a flexible portion provided around said fuse connecting portion; and retainer portions formed respectively on each said flexible portion intermediate opposite ends of said flexible portion, said retainer portions retaining said fuse in one of a first position in which said fuse is inserted in said fuse connecting portion to engage said electrical contacts and a second position in which said fuse is kept out of contact with said fuse connecting portion while said fuse holder is in a completely assembled state.

2. A fuse holder for holding a fuse, said fuse holder comprising:

a fuse connecting portion;

upstanding fuse guide walls each having a flexible portion provided around said fuse connecting portion;

retainer portions formed respectively on each said flexible portion intermediate opposite ends of said flexible portion, such that said fuse is retained in a first position so as to be inserted in said fuse connecting portion, and a second position so as to be kept out of contact with said fuse connecting portion; and flexible retainer pawls formed respectively on a distal end of each of said fuse guide walls, said fuse being held between said retainer portions and said flexible retainer pawls in said second position.

3. A fuse holder according to claim 1, wherein said retainer portions are retainer projections retaining said fuse.

4. A fuse holder according to claim 2, wherein said retainer portions are retainer projections retaining said fuse.

5. A fuse holder according to claim 1, wherein said fuse has engaging portions, corresponding to said retainer portions, formed thereon, said engaging portions being fitted against said retainer portions to hold said fuse in said second position.

6. A fuse holder according to claim 5, wherein said retainer portions are retainer holes, and said engaging portions are engaging projections.

7. A fuse holder according to claim 1, wherein each of said upstanding fuse guide walls has a pair of parallel slits formed therein to define a central flexible portion in each of aid fuse guide walls, each said central flexible portion having said retainer portion formed therein.

8. A fuse holder for holding a fuse, said fuse holder comprising:

a fuse connecting portion;

upstanding fuse guide walls each having a flexible portion provided around said fuse connecting portion; and retainer portions formed respectively on each said flexible portion intermediate opposite ends of said flexible portion, such that said fuse is retained in a first position so as to be inserted in said fuse connecting portion, and a second position so as to be kept out of contact with said fuse connecting portion, wherein said fuse has engaging portions, corresponding to said retainer portions, formed thereon, said engaging portions being fitted with said retainer portions to hold said fuse in said second position, wherein said retainer portions are retainer projections, and said engaging portions are engaging holes.

* * * * *